US005711601A

United States Patent [19]

Thomas et al.

[11] Patent Number: 5,711,601

[45] Date of Patent: Jan. 27, 1998

[54] MIXING APPARATUS FOR PULVERULENT MATERIALS

[75] Inventors: Edward George Thomas, Schaumburg; William Albert Miller, Buffalo Grove; Margaret Mary Lowan, West Chicago, all of Ill.

[73] Assignee: Fluid Management, Inc., Wheeling, Ill.

[21] Appl. No.: 670,184

[22] Filed: Jun. 21, 1996

[51] Int. Cl.[6] ..... B01F 11/00

[52] U.S. Cl. ..... 366/209; 366/217; 366/605

[58] Field of Search ..... 366/110–112, 114, 366/208, 209, 213, 214, 217, 219, 605, 210, 211

[56] References Cited

U.S. PATENT DOCUMENTS

| | | | |
|---|---|---|---|
| 2,599,833 | 6/1952 | Holmlund . | |
| 2,797,902 | 7/1957 | Beugler | 366/217 |
| 2,984,309 | 7/1961 | Brzowski . | |
| 4,281,936 | 8/1981 | Schotter et al. | 366/209 |
| 4,415,270 | 11/1983 | Heinis et al. | 366/605 X |
| 4,568,194 | 2/1986 | Gargioni | 366/213 |
| 4,789,245 | 12/1988 | Morbeck | 366/217 |
| 4,834,548 | 5/1989 | Tempel et al. | 366/208 |
| 5,197,802 | 3/1993 | Miller et al. | 366/217 |
| 5,261,744 | 11/1993 | Brunn | 366/217 |

FOREIGN PATENT DOCUMENTS

| | | | |
|---|---|---|---|
| 093091 | 11/1983 | European Pat. Off. . | |
| 2809513 | 9/1979 | Germany | 366/605 |
| 2725080 | 12/1981 | Germany . | |
| 91/08045 | 6/1991 | WIPO | 366/605 |

*Primary Examiner*—Charles E. Cooley
*Attorney, Agent, or Firm*—Fitch, Even, Tabin & Flannery

[57] ABSTRACT

Mixing apparatus develops a clamping pressure on a container to be mixed by bringing a pair of pressure plates together through the application of driving force developed by cranking a crank arm. A pawl and rachet arrangement prevents rotation of the crank arm in a direction which would loosen clamping pressure, unless a pawl unlocking knob is activated. Clamping pressure is limited by a clutch plate arrangement. Mixing apparatus is enclosed within a cabinet having a door interlock system which also automatically activates a brake for positively stopping further movement of the mixing apparatus.

18 Claims, 15 Drawing Sheets

MIXING APPARATUS FOR PULVERULENT MATERIALS

BACKGROUND OF THE INVENTION

1. Field of the Invention

The present invention pertains to mixing apparatus and in particular to apparatus for mixing the contents of a closed container, such as a paint can or the like.

2. Description of the Related Art

Continual improvements are being sought in the mass production of materials which need to be mixed prior to delivery. For example, material compositions may tend to settle over time, as during storage and transit from a manufacturer, and then through distribution channels, to an end user. Additionally, in the interest of achieving overall economies demanded by end users, there is an effort in many industries to provide a variety of custom composition materials by blending the material components at a point of sale location. In many cases these materials need to be mixed in order to render the composite product practically useful.

For example, in the color industry, paints, varnishes and other coatings, inks and other pigmented materials are typically delivered in either single color bulk form or in a previously dispensed mixture of several colors, in thin-walled containers. It is typically observed that one or more of the components of the closed container separate or otherwise undergo sedimentation processes in the container. While it is possible to open the container, as an end user would do, to stir the contents of the container, it is more desirable from a material handling standpoint to leave the container sealed, and to accomplish mixing of the components within the sealed container.

A number of different machines have been proposed to mix the contents of a closed container. Attention must be paid to the motion of the material within the container to insure that materials locally situated at the walls or bottom of the container are adequately mixed as well as materials situated in the center of the container. Different types of agitating motions are accomplished with different commercial mixers currently in use today. For example, commonly owned U.S. Pat. No. 5,197,802 is directed to a mixer which causes a sealed container to undergo a generally gyroscopic motion, with the container simultaneously rotating about two different axes. Commonly owned U.S. Pat. No. 4,497,581 disclosed mixing apparatus in which a container is rotated about an inclined access. Further, commonly owned U.S. Pat. No. 5,310,257 discloses a mixing apparatus which causes a closed container to undergo what may be termed a reciprocating motion, different from the motion of the mixing apparatus described above. Commonly owned U.S. Pat. Nos. 4,834,548 and 4,134,689 disclose further variations of mixing motions. In general, the goal of each of these mixers is to thoroughly blend or otherwise reconstitute the contents of a closed container. One figure of merit for mixing apparatus is the adequacy of the mixing result while another figure of merit is the speed with which a container can be made to achieve the desired mixing result.

Mixing apparatus of the type typically employed at a point of sale location is, of necessity, limited in physical size and weight. Due to these and other commercial restraints, even larger scale mixing apparatus is typically designed to accommodate only a single larger sized container (e.g. five gallon pail) at one time, although several smaller size containers can be accommodated, on occasion. In a high volume environment, the mixer is cycled many times in the course of a work day, with each cycle involving the loading and unloading of the sealed containers being processed.

Due to the considerable mass of the filled containers and the motion needed to adequately mix the container contents, a substantial amount of energy is imparted to the container during a mixing operation. Accordingly, it is important that the container be adequately restrained during the mixing operation. Referring, for example, to the aforementioned U.S. Pat. No. 5,197,802, a pair of clamping plates are employed for container securement. With each container loading operation, the plates must be spaced apart to allow a container to be loaded between the plates, and the plates must thereafter be brought together so as to clamp the container. At the end of a mixing operation the clamping plates must be moved apart so as to allow removal of the container from the mixing apparatus.

It has been observed that effective mixing motions imparted to a container cause certain clamping arrangements to "back off", thus loosening the clamping pressure on a container. Accordingly, various locking devices for maintaining clamping pressure have been developed, and improvements in their design and ease of manufacture are still being sought. Of course, at the conclusion of a successful mixing operation, these locking arrangements must be unlocked to allow the clamping plates to be separated, in preparation for removal of a container from the mixing apparatus. Due to the repetitive nature of the clamping, unclamping, locking, and unlocking operations that are encountered in a typical workday, improvements leading to ergonomic advantages are commercially important.

Further, as has been mentioned above, substantial amounts of energy can be stored in containers during a mixing operation, and, despite the clamping arrangements which have been developed to commercial satisfaction, concerns by labor groups and members of the public in close contact with mixing apparatus have given rise to the demand for additional isolation between the container undergoing the mixing operation and adjacent bystanders.

SUMMARY OF THE INVENTION

It is an object of the present invention to provide mixing apparatus for mixing or otherwise reconstituting the contents of closed containers.

Another object of the present invention is to provide mixing apparatus in which closed containers are clamped by the mixing apparatus.

A further object of the present invention is to provide mixing apparatus having improved clamping and clamp-locking arrangements.

A further object of the present invention is to provide mixing apparatus with additional isolation provided between the container being mixed and adjacent surrounding bystanders.

Yet another object of the present invention is to provide such additional isolation in the form of a rolling door with various safety interlock features.

These and other objects according to the principles of the present invention which can be seen from the appended description and drawings are provided in a mixing apparatus for pulverulent materials, comprising a pair of opposed pressure plates; first frame means for mounting the pressure plates for movement toward and away from each other, between clamped and unclamped positions, into and out of clamping engagement with a container disposed between the pressure plates, respectively; second frame means for mounting the pressure plates for a mixing motion which mixes the contents of the container; clamp drive means mounted on the first frame means for moving at least one of the pressure plates between the clamped and unclamped positions, the clamp drive means including a crank arm, means for rotatably mounting the crank arm to the first frame means, and at least one manually graspable handle means mounted on the crank arm for movement between locked and unlocked positions; and lock means carried by the first frame means for locking the crank arm against rotation in a first direction and for unlocking the crank arm when the crank arm is moved in a direction opposite to the first direction.

DETAILED DESCRIPTION OF THE PREFERRED EMBODIMENTS

Figure 1:
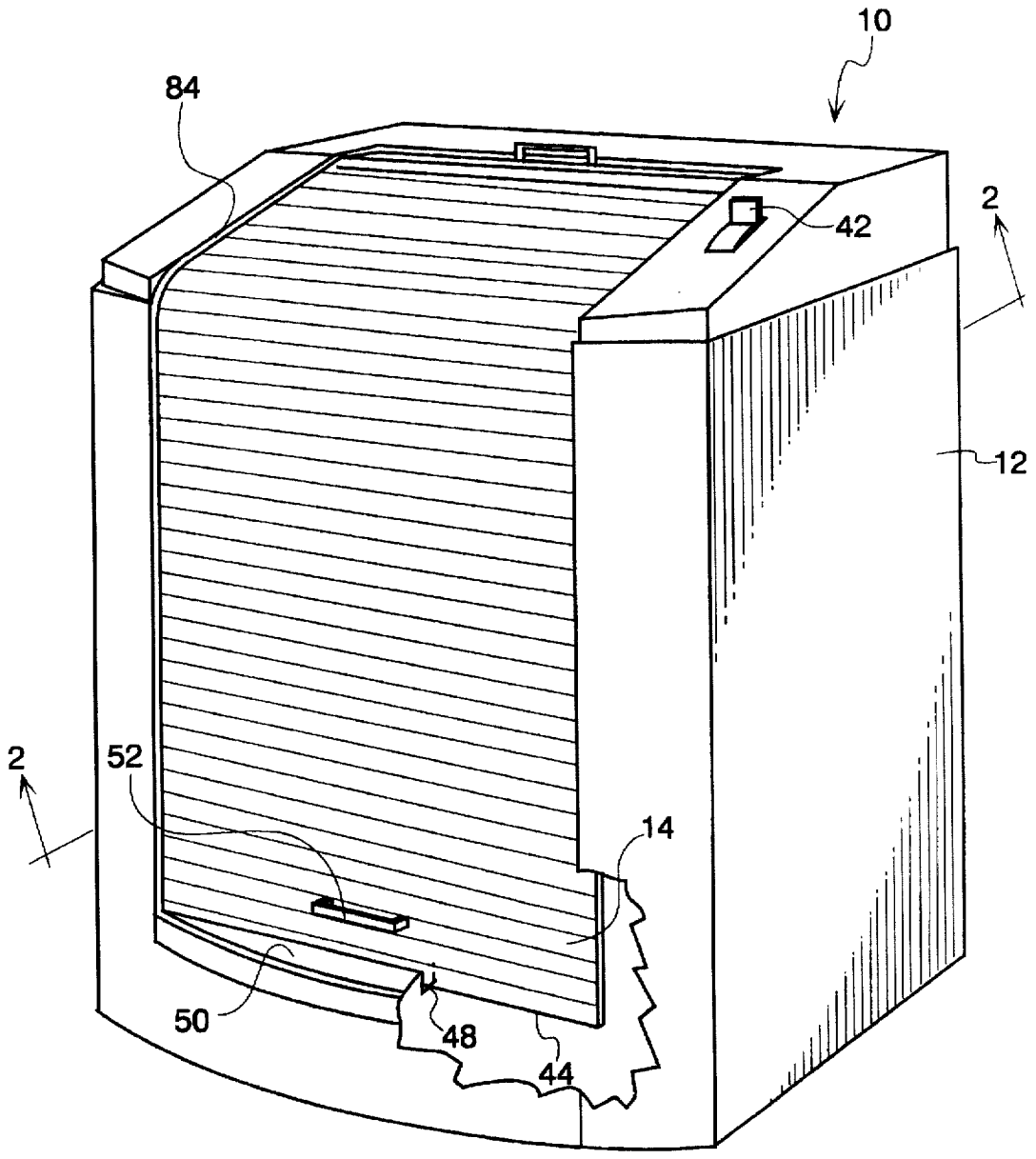
FIG. 1 is a perspective view of mixing apparatus according to the principles of the present invention.
Figure 14:
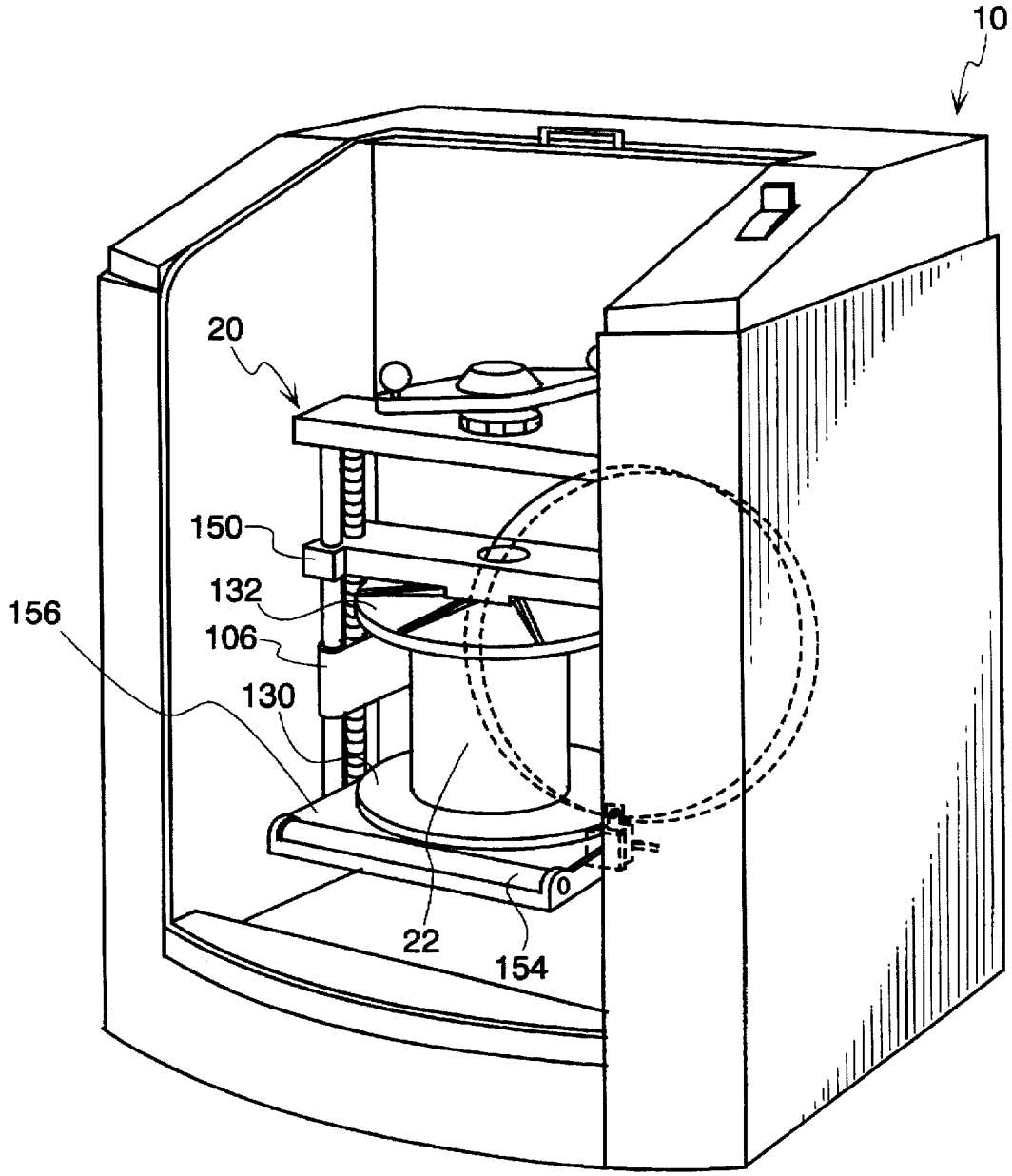
FIG. 14 is a perspective view similar to that of FIG. 1 but showing the cover in a raised position.

Referring now to the drawings and initially to FIGS. 1 and 14, a mixing device according to the principles of the present invention is generally indicated at 10. FIG. 1 shows an outer cabinet construction generally indicated at 12, with door 14 in a closed position. FIG. 14 shows mixing device 10 with door 14 in a open position to reveal mixing apparatus generally indicated at 20.

Except as noted herein, many of the features of mixing apparatus 20 are well known in the art. Mixing apparatus 20 develops a gyroscopic mixing motion in a manner similar to that disclosed in commonly owned U.S. Pat. No. 5,197,802, the disclosure of which is herein incorporated by reference as if fully set forth herein. A container 22 to be mixed is rotated about a central axis through the cylindrical container (i.e. a vertical axis for the container position shown in FIG. 14). The framework visible in FIG. 14 is mounted for rotation about a horizontal axis, being cantilevered from the hub 106 of a drive wheel 26, as shown, for example, in FIG. 2. Drive wheel 26 is rotatably driven by a pulley 28 (see FIG. 2) driven by a motor M through a drive belt 30 (see FIG. 3).

Figure 2:
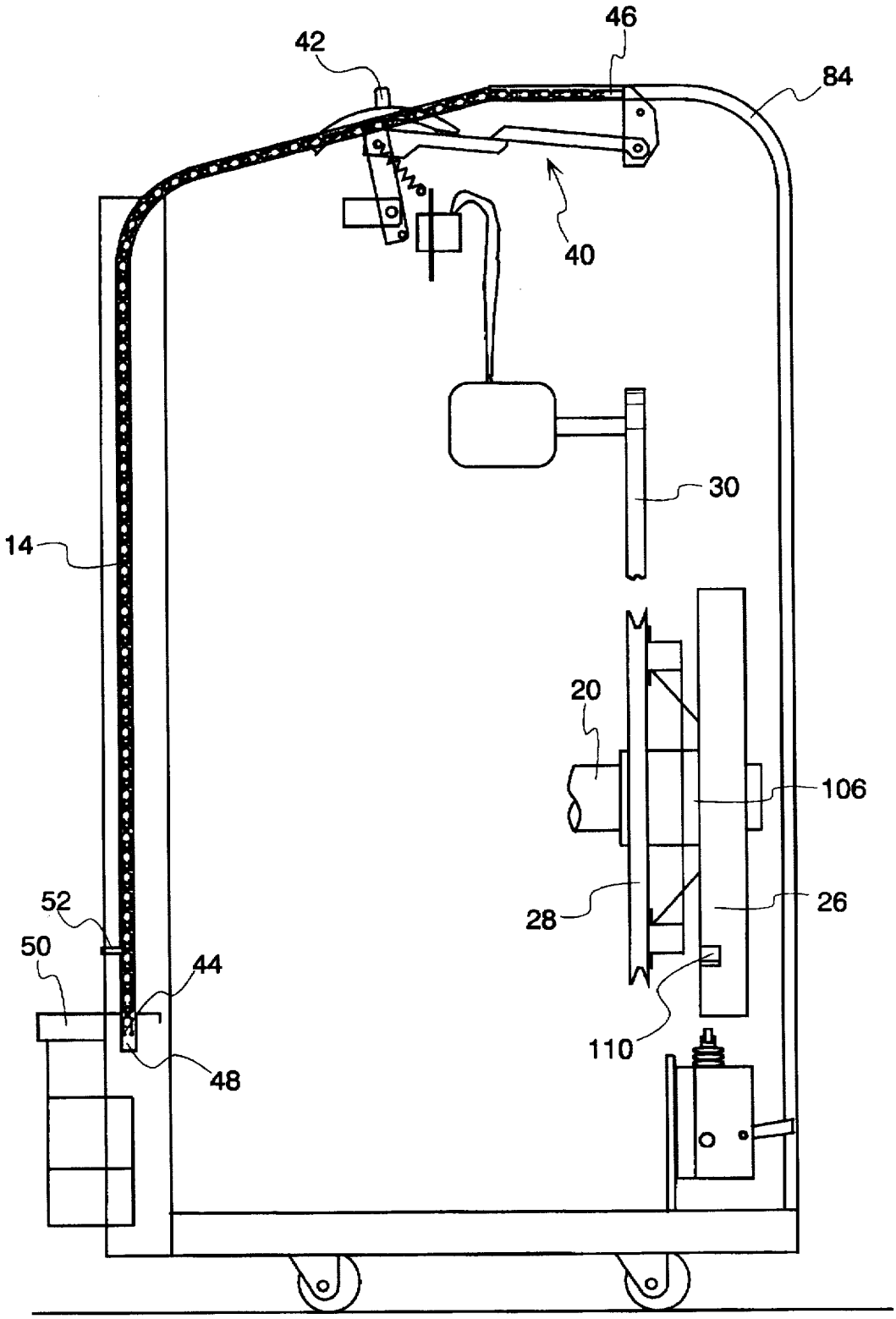
FIG. 2 is a cross-sectional view taken along the line 2—2 of FIG. 1.
Figure 3:
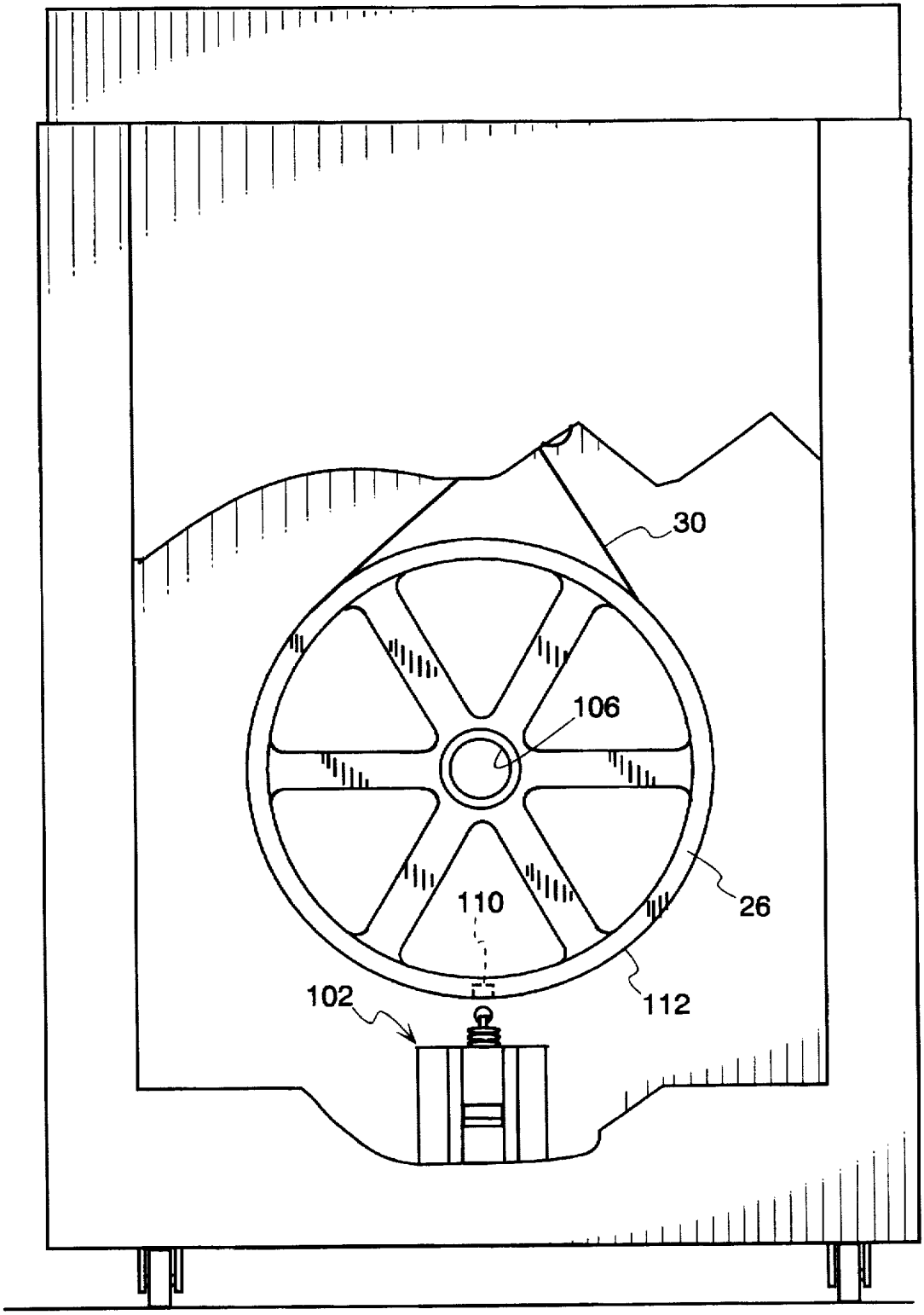
FIG. 3 is a rear elevational view thereof.

Referring to FIGS. 1–10, an interlocking control arrangement is generally indicated at 40 and includes a manually graspable switch handle 42 which extends through the upper end of cabinet 12. As can be seen in FIG. 2, door 14 has a front end 44 and a rear end 46. FIGS. 1 and 2 show door 14 in a fully closed position, with the forward end 44 received in a groove or recess 48 shielded by the forwardly located threshold plate 50. A manually graspable handle 52 is located adjacent forward end 44. As will be seen herein, if a user should grasp and pull handle 52, as shown in FIGS. 1 and 2, the user will find that door 14 is rendered immovable, due to the interlock system 40.

Figure 4:
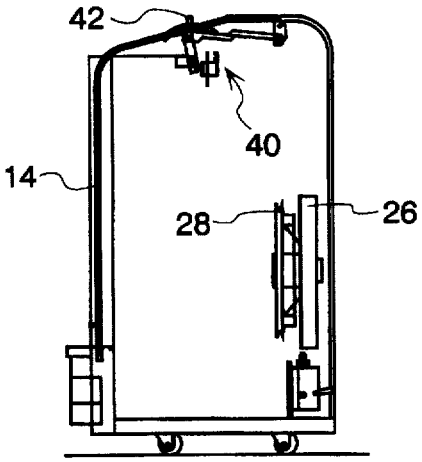
FIGS. 4–7 are views similar to FIG. 2 but showing a sequence of operation.
Figure 5:
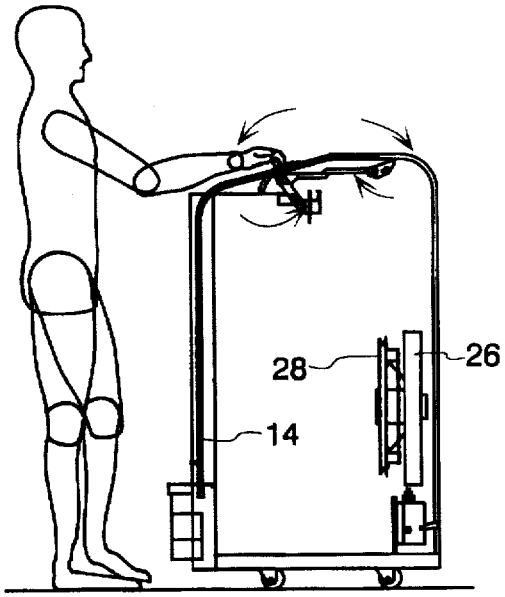
Figure 6:
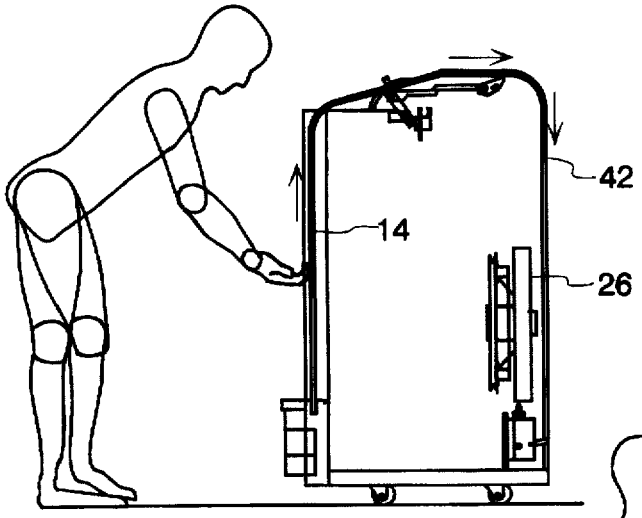
Figure 7:
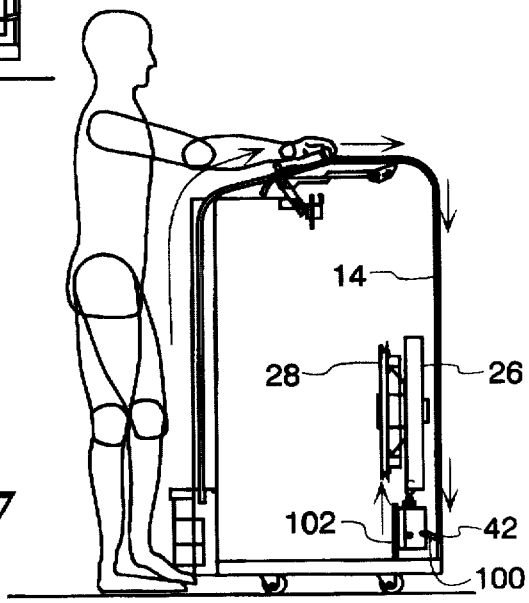

Referring to FIGS. 4–7, by way of a brief overview, FIG. 4 shows the door 14 in a fully closed position with handle 42 moved to a permissive position (shown in FIG. 8) which allows the electrical drive motor for the mixing mechanism to be energized. Before opening of the door, a user must grasp the handle 42, moving it to the off position shown in FIGS. 5 and 9, to permit door 14 to be opened as indicated in FIGS. 6, 7 and 10. As will be seen herein, with the door 14 in a fully opened position as illustrated in FIG. 7, the mixing mechanism is engaged by a brake to prepare the mechanism for a reloading operation. After a container has been placed in the mixing device, the sequence of operation is reversed with door 14 being moved to a closed position, and with handle 42 being moved to the permissive position.

Figure 8:
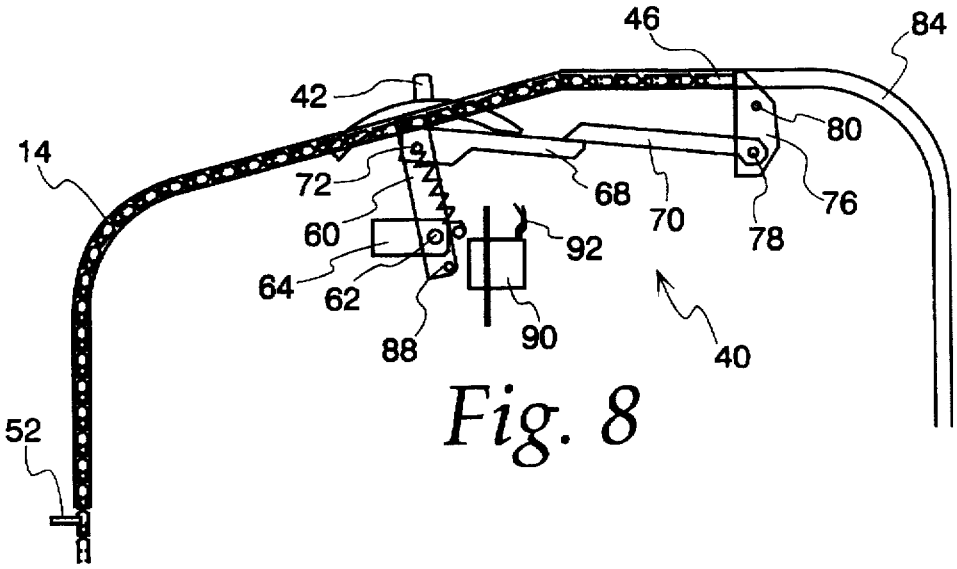
FIGS. 8–10 are fragmentary cross-sectional views corresponding to the sequence of operation shown in FIGS. 4–7.
Figure 9:
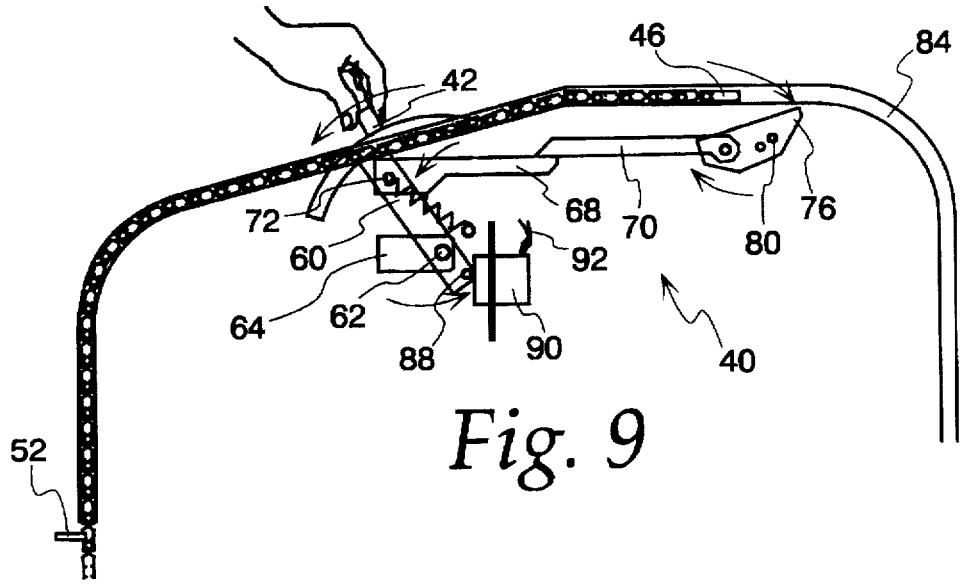
Figure 10:
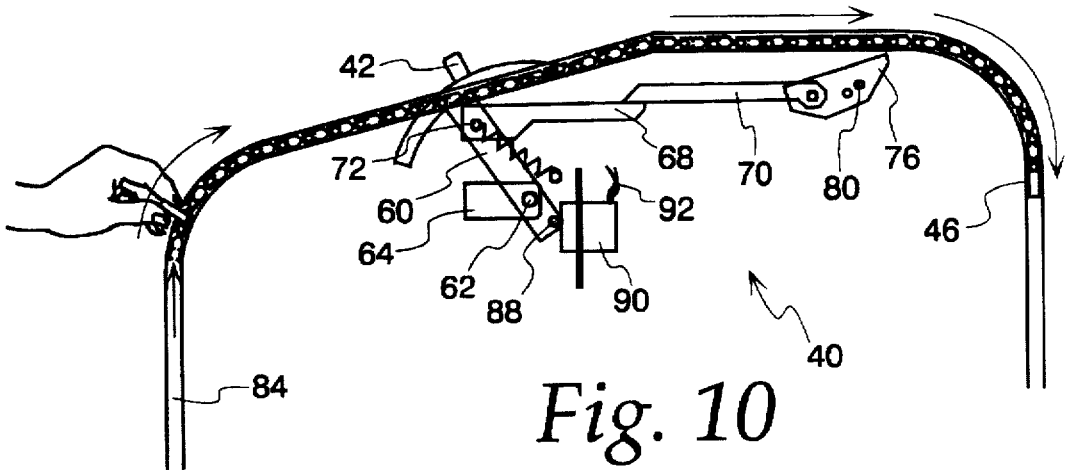

Referring now to FIGS. 8-10, interlock system 40 includes the aforementioned switch handle 42 mounted at the upper free end of an arm 60. Arm 60 is pinned at 62 to a internal frame member 64. Articulated linkage arms 68, 70 are pinned at 72 to the upper end of arm 60. The pin connection 72 and hence the free end of arm 68 travels an arcuate path, following the angle of displacement of switch handle 42 as it is moved between the operating positions shown in FIGS. 8 and 10. A stop member 76 is pinned at 78 to the free end of arm 70. Stop member 76 pivots about pin member 80 which is secured to an internal frame member (not shown) of cabinet 12.

As switch handle 42 is moved from its operating positions shown in FIGS. 8 and 10, rotational force is applied to stop member 76 for bringing the stop member into and out of the path of travel of door 14. For example, with switch handle 42 shown in the permissive position of FIG. 8, stop member 76 is rotated into the path of travel of door 14, preventing its opening. As switch handle 42 is moved as indicated in FIG. 9 to the off position illustrated in FIG. 10, stop member 76 is moved out of the path of travel of door 14, allowing the door to be opened. If an operator attempts to move switch handle 42 to the permissive position while the door is open, i.e. in the position shown in FIG. 10, stop member 76 will be blocked by door 14 from assuming the position shown in FIG. 8, effectively preventing an operator from moving the switch handle 42 to the permissive position while the door is even partly open.

In the preferred embodiment, with the permissive position shown in FIG. 8, the rearward end 46 of door 14 contacts stop member 76 while the forward end 44 is received within recess 48, below threshold 50, as shown, for example, in FIG. 2. Thus, the forward end 44 of door 14 is held captive at its forward end by recess 48 preventing inward or outward displacement of the lower end of door 14, and further the rearward end 46 is held captive in recessed grooves or tracks 84 formed in cabinet 12. As will be appreciated, stop member 76 effectively closes off the remaining degree of freedom permitted door 14, thus easily and automatically achieving desired control over door 14 to effectively defeat any compromise of the integrity of the enclosure surrounding the mixing mechanism.

With the switch handle 42 moved to the off position of FIG. 10, the lower free end 88 of arm 60 contacts and depresses a switch 90. In a preferred embodiment, switch 90 has electrical leads 92 coupled to the drive motor of the mixing mechanism. In the preferred embodiment, the drive motor is of the electrical type, although it will be readily appreciated that switch 90 could be coupled to a solenoid or air valve controlling energization of a pneumatic motor. As a further alternative, switch 90 could be of the fluid control type with direct fluid connection to a fluidically operated drive motor. In the preferred embodiment, switch 90 opens the electrical energization circuits for the mixing drive motor when switch handle 42 is moved to the off position shown, for example, in FIG. 10.

Turning now to FIGS. 7 and 11–13, and initially to FIG. 7, as door 14 is moved to the fully opened position, its bottom end 42 contacts a lever arm 100 of a brake arrangement 102. As mentioned above, mixing apparatus 20 is connected to pulley 28, which in turn is coupled through drive belt 32 to drive motor M (FIG. 2). As shown in FIG. 2, pulley 28 is mounted on a hub 106 which also mounts wheel 26. As can be seen in FIGS. 2 and 11–13, for example, wheel 26 has a notch or recess 110 formed in the outer peripheral edge 112 thereof.

Figure 11:
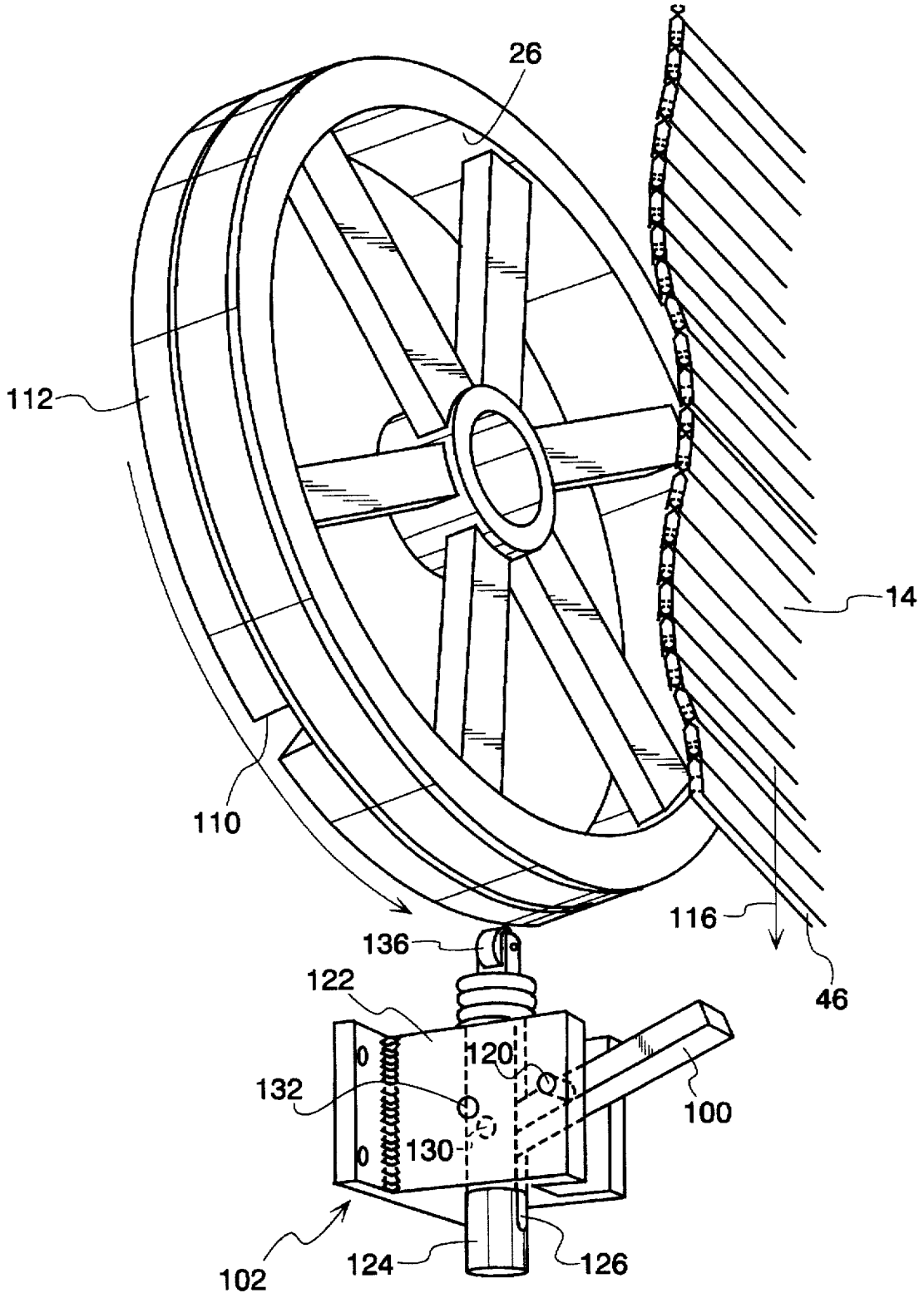
FIGS. 11–13 are fragmentary perspective views of the braking apparatus thereof.
Figure 12:
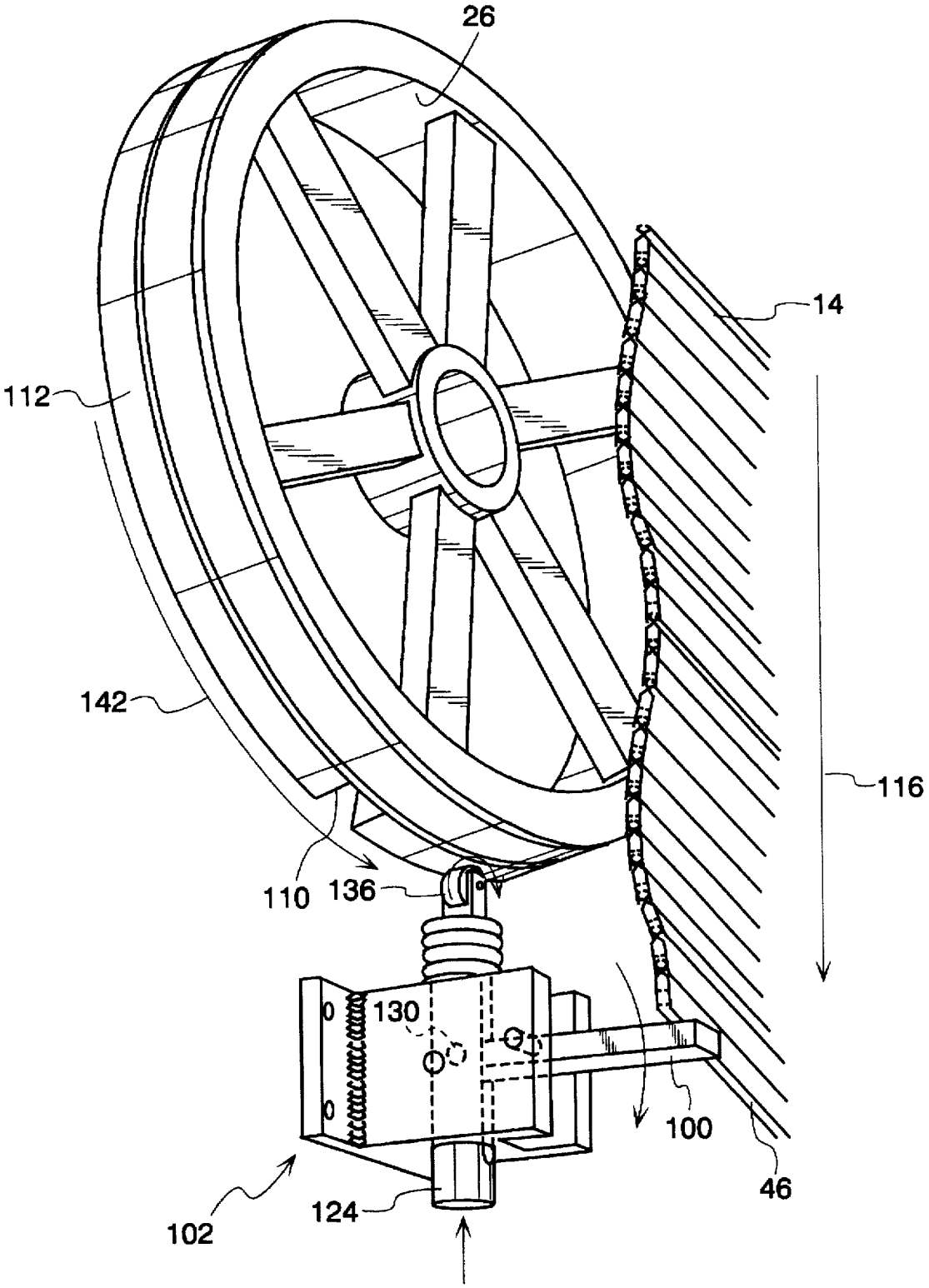
Figure 13:
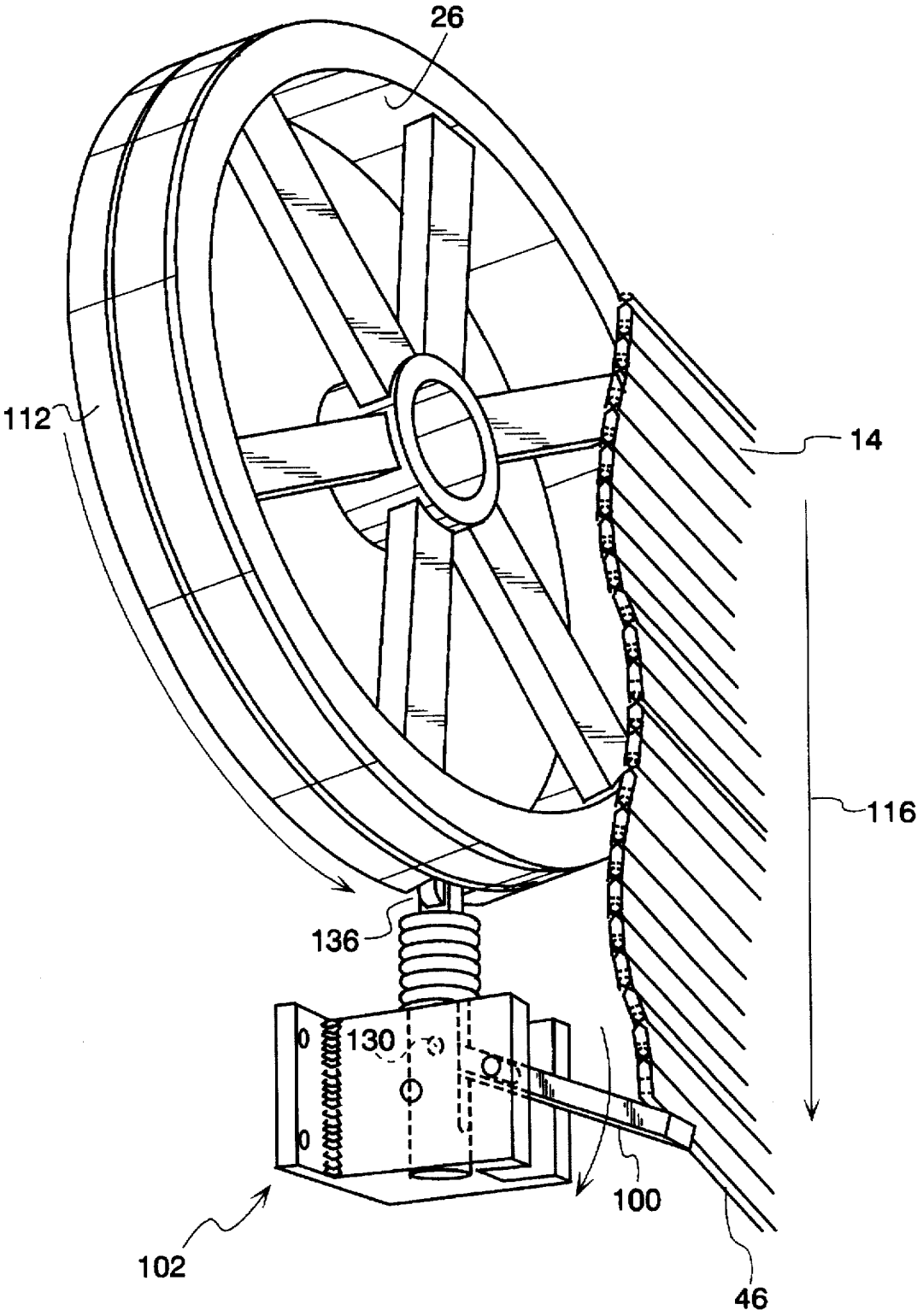

Referring now to FIGS. 11–13, as door 14 is moved in the downward direction of arrow 116, it rear edge 46 is moved toward lever arm 100. Lever arm 100 is pinned at 130 to plunger 124. Referring to FIG. 11, an aperture 132 is formed in support structure 122 to allow the pin connection at 130 to be formed during an assembly operation at the manufacturer's facility. In the preferred embodiment, pivot connection 130 includes a pin securely fastened to plunger 124, and passing through an elongated slotted hole in the internal lower inward end of lever arm 100, with the direction of elongation of the hold extending in the direction of elongation of the lever arm. With continued downward movement of door 14, lever arm 100, pivotally mounted at 120 to a supporting frame portion 122 of cabinet 12, is moved to a downward position. Braking arrangement 102 includes a generally cylindrical plunger 124 which is slotted at 126 (see FIG. 11) to receive the remaining, free end of lever arm 100. Accordingly, as door 14 engages lever arm 100 (causing rotation of the lever arm as illustrated in FIGS. 12 and 13) plunger 124 is moved in an upward direction.

A roller 136 is rotatably mounted at the upper end of plunger 124. As door 14 urges the free end of lever arm 100 in a downward direction as indicated in FIG. 12, roller 136 is brought into contact with the outer peripheral surface 112 of wheel 26. As indicated above, an operator must move switch handle 42 to the off position illustrated in FIG. 10 before door 14 can be opened. If desired, a timing control can be provided for drive motor M to de-energize the motor beforehand, at the end of a mixing operation. If a sufficient amount of time is allowed to pass after de-energization of the drive motor, the mixing apparatus 20 will eventually come to a rest position.

However, it is also desirable that interlock system 40 be employed to de-energize the drive motor M while power is being applied to the mixing apparatus 20. Frictional forces of the mixing apparatus and moving parts associated therewith will quickly bring the mixing apparatus to a rest position. It is preferred that, within an average time required to fully open the door 14, the mixing apparatus and particularly the wheel 26 still be coasting toward a rest position as door 14 is moved to the fully open position, shown, for example, in FIGS. 7 and 12. If necessary, friction elements can be added to hasten the coast-down time. During coast-down, wheel 26 is still undergoing rotation as indicated by arrow 142. Roller 136 comes in contact with the peripheral edge 112 of wheel 26, and rotates as indicated by the arrow in FIG. 12.

During the period of time indicated in FIG. 12, downward pressure is continually exerted on the free end of lever arm 100, and thus roller 136 is continuously pressed against wheel 26 with a defined pressure. In a relatively brief time, a notch or recess 110 formed in wheel 26 is moved to the position illustrated in FIG. 13 so as to receive roller 136, thus locking wheel 26 and hence the mixing apparatus 20 and container loaded therein, at a predefined rest position. In a preferred embodiment, the predefined rest position of mixing apparatus is generally that as indicated in FIG. 14, with the central axis of container 22 oriented in a generally vertical direction. If desired, other predefined positions of the container can be selected by repositioning the notch or recess 110. If desired, roller 136 can be coupled to plunger 124 through a shock absorbing spring, such as that illustrated in FIG. 12, for example.

Figure 15:
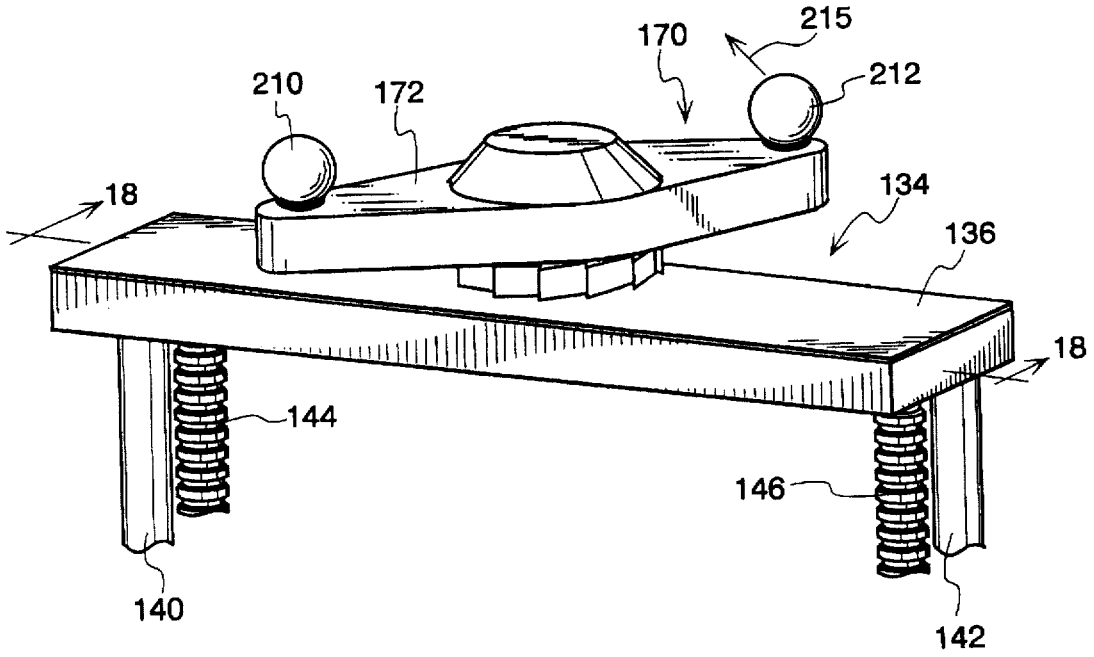
FIG. 15 is a fragmentary perspective view of the crank arrangement shown in FIG. 14.
Figure 16:
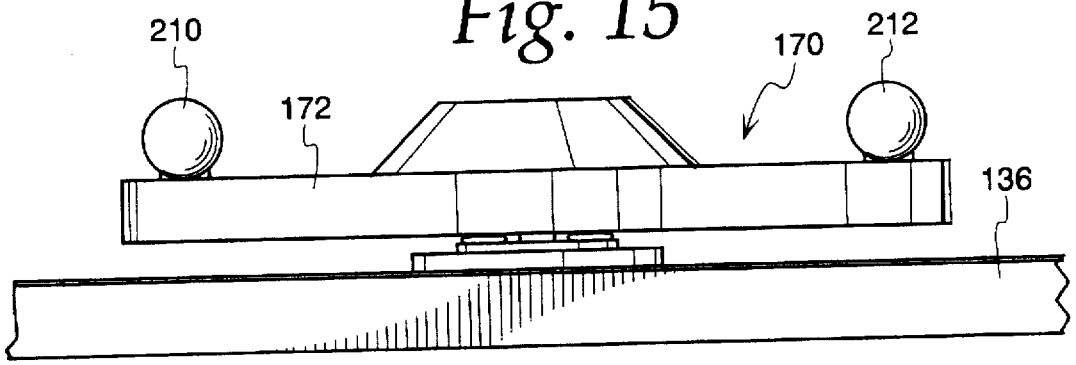
FIG. 16 is a fragmentary side elevational view thereof.
Figure 27:
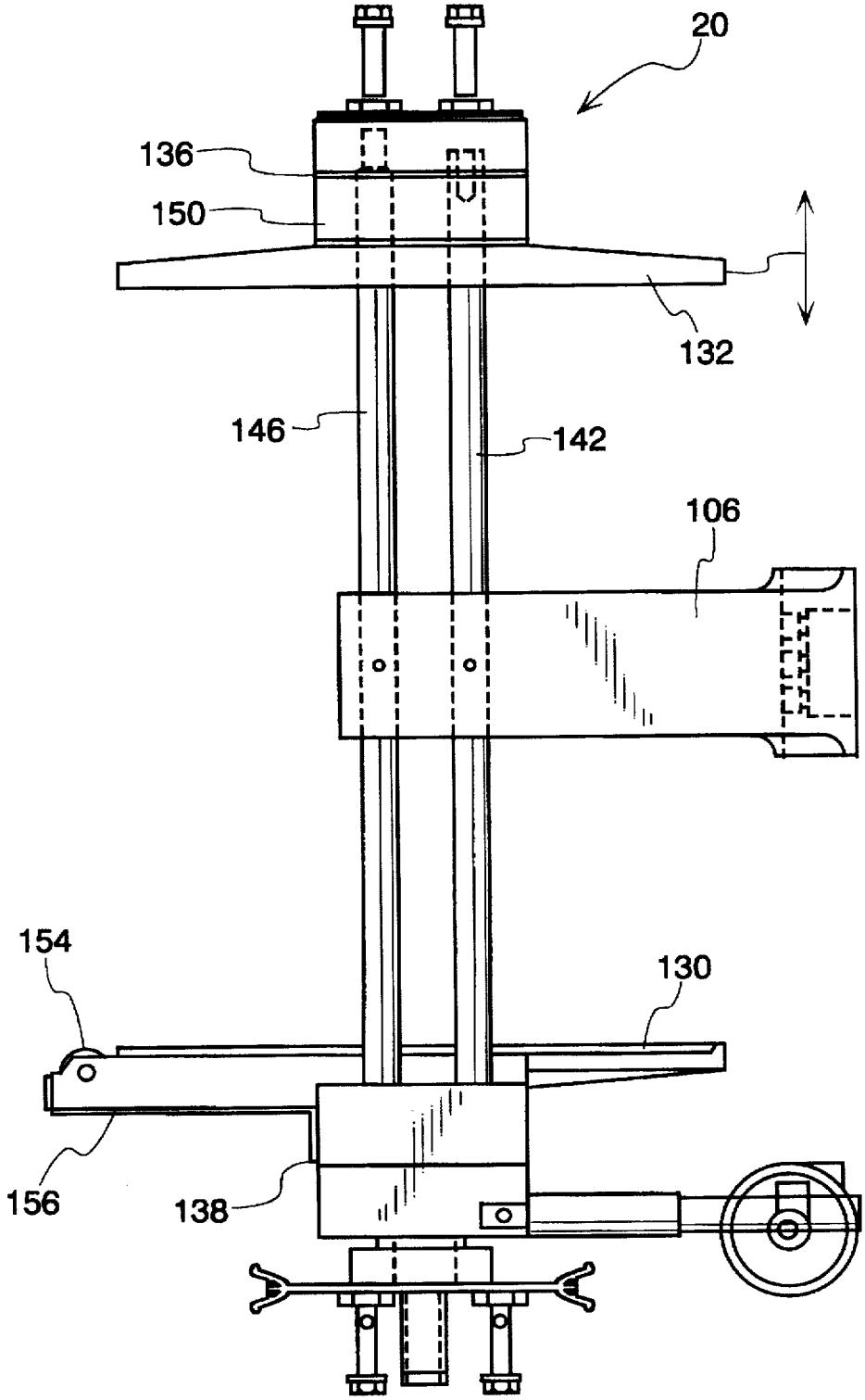
FIG. 27 is a side elevational view of the mixing apparatus thereof.

Referring now to FIGS. 14, 15 and 27, mixing apparatus 20 includes a lower fixed clamping plate 130 and an upper movable clamping plate 132. As seen in FIG. 15, an inner frame generally indicated at 134 includes an upper cross member 136 (which will be seen to house a gear train assembly) and a lower cross member 138, with the cross members secured together by support rods 140, 142 (see FIG. 15). Threaded rods 144, 146 are journaled at their lower ends in cross member 138 and are gear driven at their upper ends through a gear train located within cross member 136. The hub member 106 has an arcuate or yoke-shaped portion secured to support rods 140, 142. Preferably, the yoke portion of hub mounting 106 provides rotatable support for the threaded rods 144, 146 to support the mid portions of the threaded rods.

As indicated in FIG. 14, the container 22 is placed atop lower clamping plate 130 and upper clamping plate 132 is lowered into position to contact container 22 in a compressive engagement therewith. The upper clamping plate 132 is mounted to a traveling cross member 150 which slidingly engages support rods 140, 142 at its diagonally opposite corners, and which threadingly engages threaded rods 144, 146 at its remaining pair of diagonally opposite corners. As threaded rods 144, 146 are rotated about their central longitudinal axes, traveling plate 150 is moved in upward and downward directions, thus moving upper clamping plate 132 toward and away from lower clamping plate 130. In order to aid loading of container 22, a roller 154 is positioned at the forward free edge of table 156 which rotatably supports the lower clamping plate 130.

Figure 23:
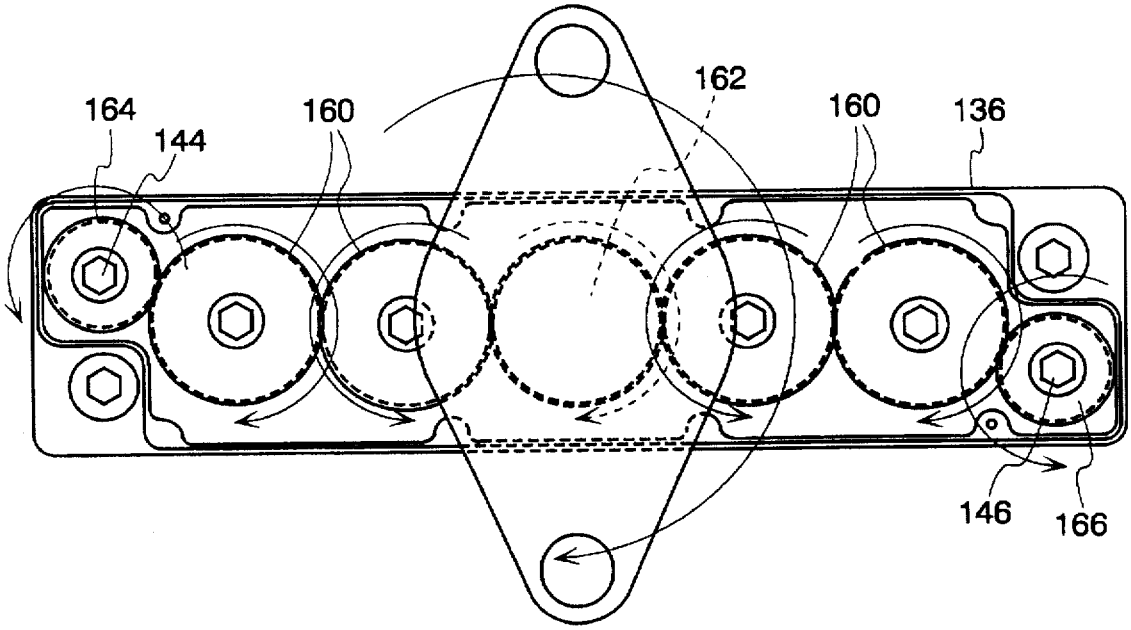
FIG. 23 is a top plan view of the arrangement shown in FIG. 15, with the top cover of the gear box removed.

Referring now to FIGS. 15 and 23, upper cross member 136 comprises a hollow rectangular enclosure, the upper wall of which has been removed in FIG. 23 to expose a train of gears 160 coupling a central gear 162 to outboard gears 164, 166 affixed to the upper ends of threaded shafts 144, 146, respectively. Thus, as central gear 162 is rotated, threaded shafts 144, 146 are rotated together, in synchronism.

Figure 17:
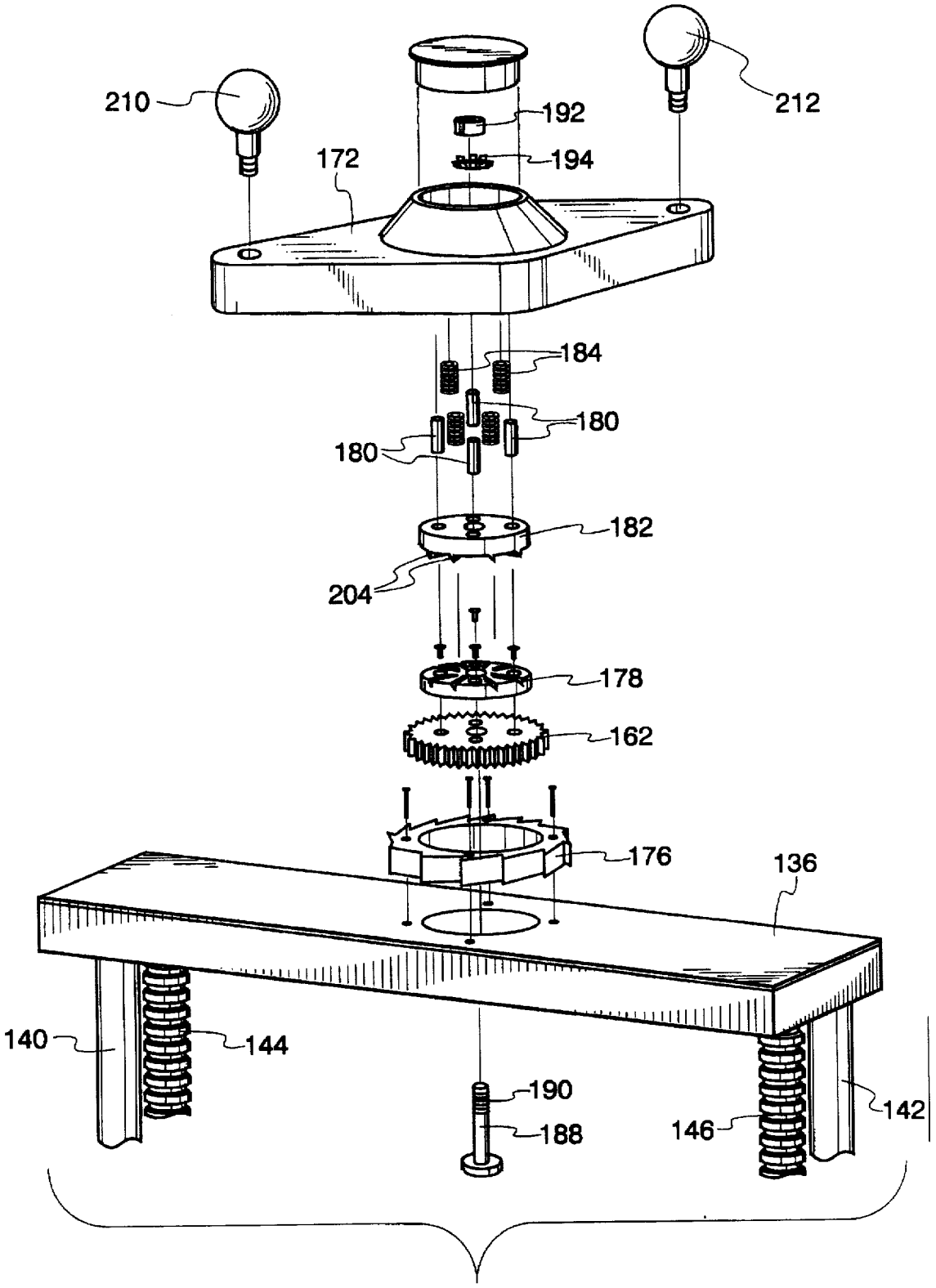
FIG. 17 is a fragmentary exploded view thereof.
Figure 18:
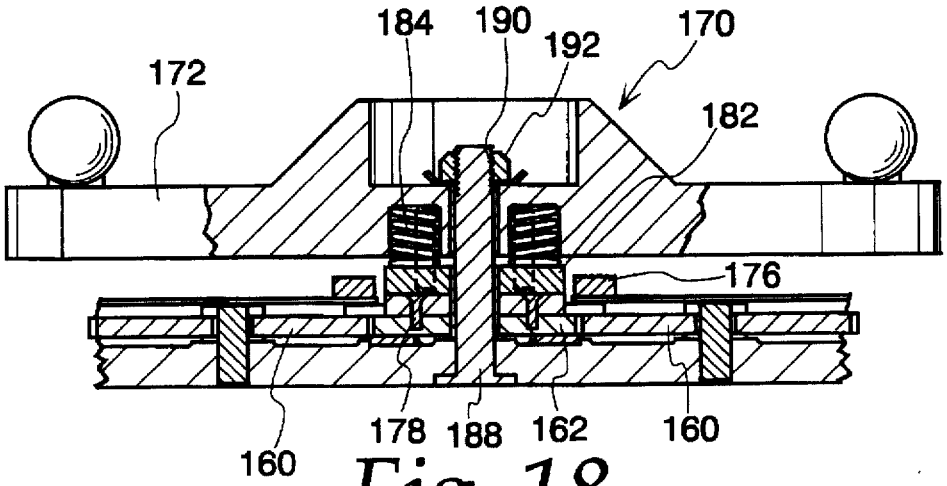
FIGS. 18–20 are fragmentary cross-sectional views corresponding to FIG. 16.
Figure 19:
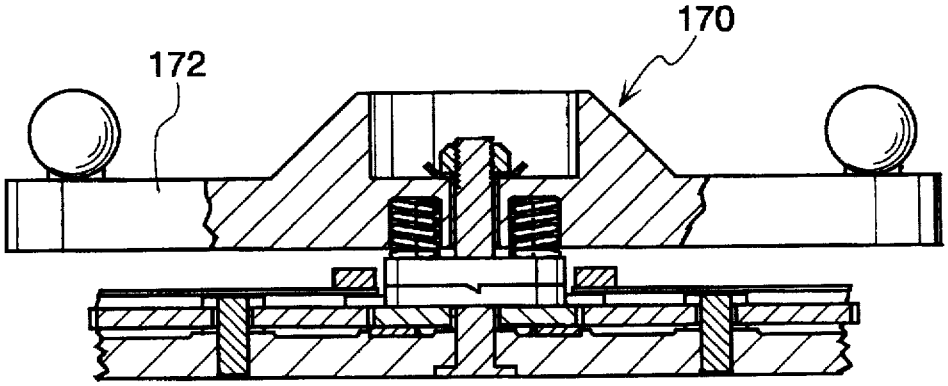
Figure 20:
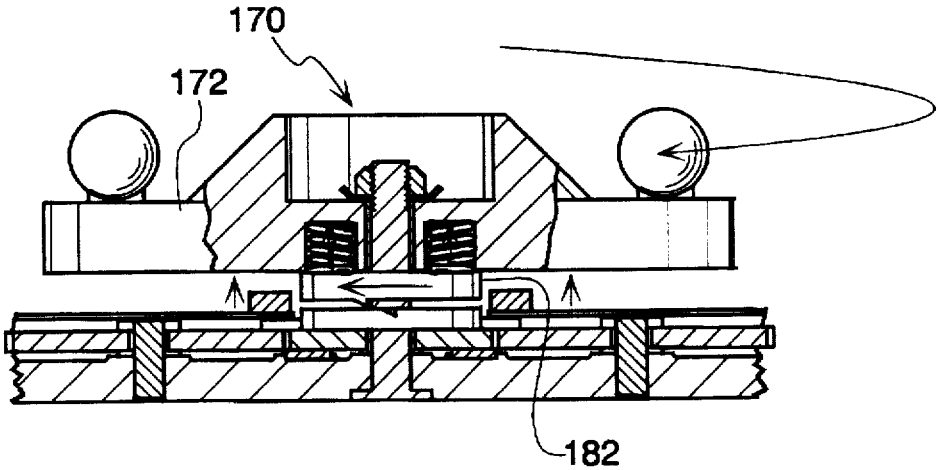

Referring now to FIGS. 15–26, a manually operated drive assembly is generally indicated at 170. Drive assembly 170 includes a crank arm 172, preferably taking the form of a hollow housing, which, as will be seen herein, contains an internal drive clutch arrangement and related components shown, for example, in FIG. 17. As will be seen herein, as crank arm 172 is rotated about a vertical axis of rotation, threaded shafts 144, 146 are rotated about their respective longitudinal axes, thus moving the upper clamping plate 132 in upward or downward travel. FIG. 18 is a cross-sectional view taken along the ling 18—18 of FIG. 15, but with the crank arm 172 having its longitudinal axis aligned with line 18—18.

Turning now to FIG. 17, a rachet gear 176 is attached to the upper end of cross member 136 by threaded fasteners. In FIG. 17 the aforementioned central gear 162 is shown above rachet gear 176 for clarity of illustration, and it should be understood that the central gear 162 is, in its final installed position, located underneath rachet gear 176, within the hollow enclosure of cross member 136. A lower clutch plate 178 is attached to central drive gear 162 by threaded fasteners. A plurality of pins 180 are pressed into crank arm 172 and are received in corresponding apertures formed in an upper clutch plate 182. Springs 184 are inserted over pins 180, so as to bias upper clutch plate 182 in a downward direction, into engagement with lower clutch plate 178. A support stud 188 having an upper threaded end 190 is secured to the bottom wall of cross member 136, as can be seen, for example, in FIGS. 18–20. A nut fastener 192 and lock washer 194 secure the crank arm 172 to the threaded end 190 of stud 188.

In the preferred embodiment, stud member 188 is dimensioned such that nut fastener 192 is permitted a range of travel on the upper threaded end 190, to alter the preloading or static compression of springs 184, to provide a clutch adjustment. In a preferred embodiment, the clutch arrangement limits the amount of compressive clamping torque applied to the threaded shaft 144, 146, thus limiting the pressure which can be applied to container 22 as crank arm 172 is operated to draw the clamping plates 130, 132 together. As mentioned, the amount of clamping pressure can be readily controlled by adjusting the position of nut fastener 192 on threaded end 190 of stud 188.

Figure 21:
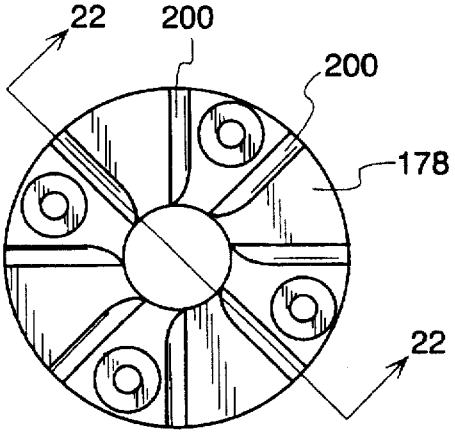
FIG. 21 is a top plan view of a clutch plate of the crank arrangement.
Figure 22:
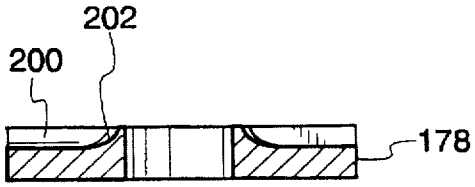
FIG. 22 is a cross-sectional view thereof taken along the line 22—22 of FIG. 21.

Referring to FIGS. 21 and 22, the lower clamping plate 178 has a generally cylindrical configuration, with a series of radially directed grooves 200 formed in its upper surface. As can be seen in FIG. 22, the grooves 200 have a tapered depth at their radially inner ends. As can be seen in FIG. 21, the radially inner ends of grooves 200 are also tapered in plan view. Upper clamping plate 182 has a plurality of teeth 204 (see FIG. 17) which are received in grooves 200 and which are complementary shaped so as to completely fill the grooves 200 when the opposed mating faces of clutch plates 178, 182 are brought together, as shown, for example, in FIGS. 18 and 19. Even though the clutch plates have tapered teeth and grooves, they allow clutch slippage in only one rotational direction (i.e. cam tightening) and are locked in the opposite (i.e. cam loosening) direction.

As crank arm 172 is rotated about a vertical axis, its apparent width is shortened as the perspective viewing of the elongated crank arm 172 is changed. Rotation of crank arm 172 causes pins 180 to apply a torque to upper clutch plate 182, bringing the teeth 204 of upper clutch plate 182 out of engagement with grooves 200 and lower clutch plate 178, causing the upper clutch plate 182 to ride along pins 180, so as to further compress springs 184. With continued rotation of crank arm 172, the teeth 204 are again aligned with grooves 200 and are received in the grooves. However, continued turning of crank arm 172 fails to move the lower clutch plate 178, and thus the gear train coupled to threaded shafts 144, 146 is not driven.

Figure 24:
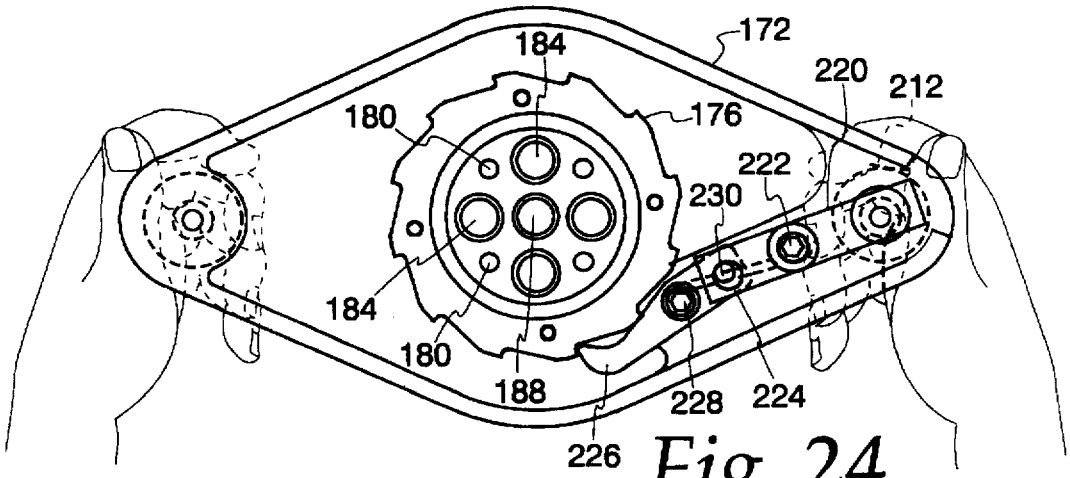
FIGS. 24–26 are bottom plan views of the crank arrangement shown in sequence of steps in an unlocking operation.
Figure 25:
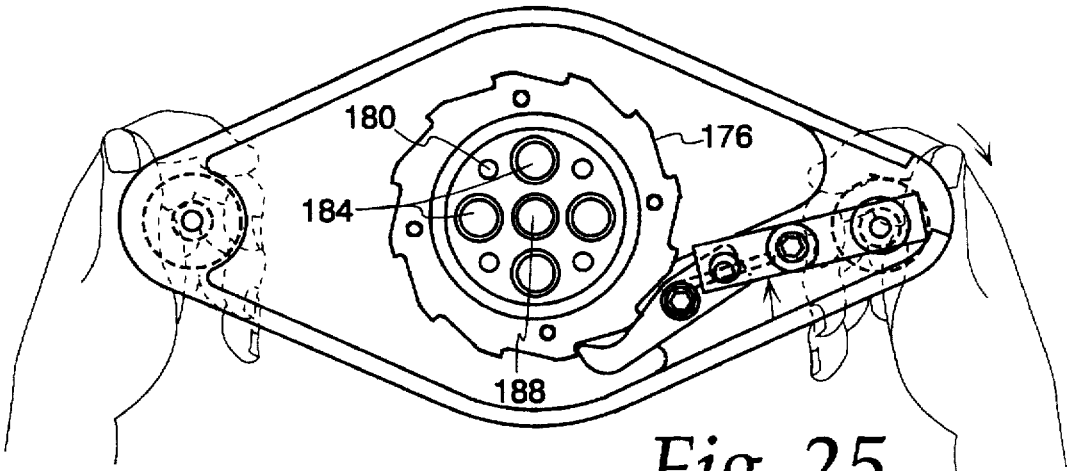
Figure 26:
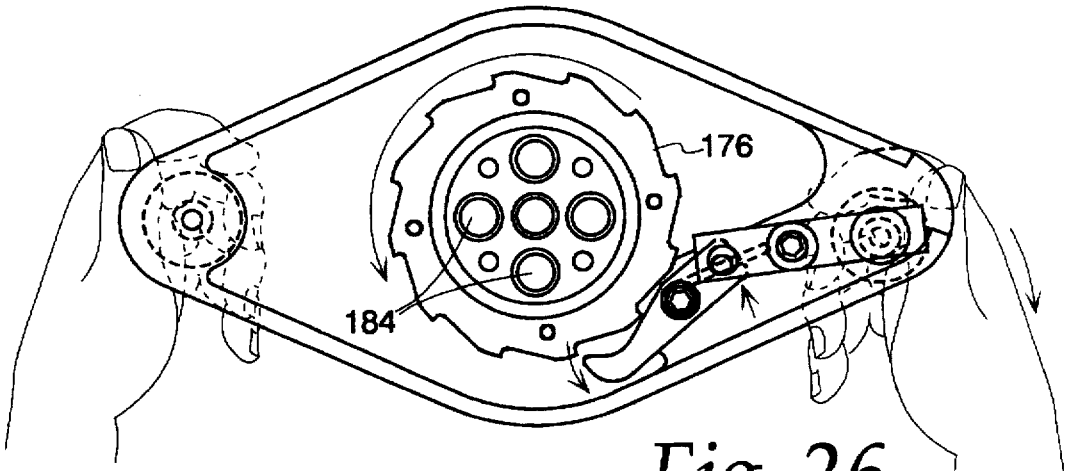

Turning now to FIGS. 24–26, a locking arrangement of the drive mechanism 170 is shown. FIGS. 24–26 show the underside elevation view of crank arm 172 and the various components illustrated in FIG. 17 installed therein. As mentioned, the rachet gear 176 is secured to upper cross member 136, but is shown detached therefrom in FIGS. 24–26 for explanatory purposes. Further, for purposes of explanation it should be understood that central gear 162 and clutch plates are shown removed in FIGS. 24–26.

As can be seen in FIG. 17, a pair of manually graspable knobs 210, 212 are installed at either end of the generally diamond-shaped crank arm 172. In the preferred embodiment, knob 210 is fixedly secured to crank arm 172 whereas knob 212 is allowed to rock in the direction of arrow 214 in FIG. 15. In the preferred embodiment, knob 212 is not allowed a symmetrical movement about the mid plane of crank arm 172 but rather is allowed movement only toward one side of that mid plane, that is, the movement allowed knob 212 is associated with rotation of crank arm 172 in a direction which unclamps pressure applied to container 22. As a user applies pressure to knobs 210, 212 so as to cause the rotation of crank arm 172 to move the clamping plates away from one another, linkage arm 220 is pivoted between the positions illustrated in FIGS. 24 and 26.

Referring to FIG. 24, a linkage arm 220 is pivotally connected at 222 to crank arm 172. Lever arm 220 has a threaded aperture at one end for receiving the threaded lower end of knob 212 and has an aperture 224 at its opposite end. A pawl 226 is pivotally connected at 228 to crank arm 172. Pawl 226 includes a pin 230 which is received in aperture 224.

As arm 220 is pivoted about connection 222, pin 230 is deflected in the manner illustrated in FIGS. 25 and 26 so as to bring the toothed end of pawl 226 out of engagement with rachet gear 176, in the manner illustrated in FIG. 26. This allows the crank arm 172 to be rotated in a direction which moves the clamping plates 130, 132 away from each other. Pawl 226 and rachet 176 work in a conventional manner as crank arm 172 is rotated to bring clamping plates 130, 132 together. With reference to FIG. 24, the toothed end of pawl 226 cams over the teeth of rachet gear 176 as the clamping plates are brought toward one another. Eventually, with sufficient rotation of crank arm 172, upper clamping plate 132 is brought into contact with container 22 and compressive pressure applied to container 22 begins to increase. As the compressive pressure reaches a predetermined limit, the clutch plates 182, 178 undergo relative angular displacement, thus braking the application of driving energy to the gear train coupling central gear 162 to threaded shafts 144, 146. At this point, the pawl and rachet arrangement prevents crank arm 172 from rotating in a direction which would relieve clamping pressure.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Mixing apparatus for pulverulent materials, comprising:

a pair of opposed pressure plates;

first frame means for mounting the pressure plates for movement toward and away from each other, between clamped and unclamped positions, into and out of clamping engagement with a container disposed between the pressure plates, respectively;

second frame means for mounting the pressure plates for a mixing motion which mixes the contents of the container;

clamp drive means mounted on the first frame means for moving at least one of the pressure plates between the clamped and unclamped positions, the clamp drive means including a crank arm, means for rotatably mounting the crank arm to the first frame means, and at least one manually graspable handle means mounted on the crank arm for movement between locked and unlocked positions; and lock means carried by the first frame means for locking the crank arm against rotation in a first direction and for unlocking the crank arm when the crank arm is moved in a direction opposite to the first direction, the lock means comprising ratchet gear means carried by the first frame means and pawl means carried by the crank arm, the pawl means including a lever arm pivotally mounted to the crank arm and a pawl member pivotally mounted to the crank arm, with one of the crank arm and the pawl member carrying a pin and the other of the crank arm and the pawl member defining an aperture for receiving the pin, so that as the lever arm is pivoted, the pawl member is disengaged from the ratchet gear means.

2. The apparatus of claim 1 wherein the handle means comprises a knob means for manually grasping the crank arm for driving rotation thereof, with the knob means attached to the lever arm.

3. The, apparatus of claim 2 wherein the aperture, the means for rotatably mounting the crank arm and the pivotal mounting of the pawl member cooperate to allow displacement of the lever arm only when the crank arm is moved in a direction which moves the pressure plates away from each other.

4. The apparatus of claim 3 further comprising a pair of threaded rods threadingly coupled to one of the pressure plates, and gear train means coupling the crank arm to the threaded rods for substantially simultaneous rotation thereof so as to advance the one pressure plate along the threaded rods as the threaded rods are rotated in response to rotation of the crank arm.

5. Mixing apparatus for pulverulent materials, comprising:

a pair of opposed pressure plates;

first frame means for mounting the pressure plates for movement toward and away from each other, between clamped and unclamped positions, into and out of clamping engagement with a container disposed between the pressure plates, respectively;

second frame means for mounting the pressure plates for a mixing motion which mixes the contents of the container;

clamp drive means mounted on the first frame means for moving at least one of the pressure plates between the clamped and unclamped positions, the clamp drive means including a crank arm, means for rotatably mounting the crank arm to the first frame means, and at least one manually graspable handle means which is mounted on the crank arm for movement between locked and unlocked positions; and clutch means carried by the first frame means, coupling the crank arm to the pressure plates so as to limit the force applied by the crank arm to the pressure plates.

6. The apparatus of claim 5 wherein the clutch means disengages connection of the crank arm to the pressure plates when a predetermined clamping force is developed by the pressure plates.

7. The apparatus of claim 6 wherein the clutch means comprises first and second generally cylindrical clutch plates having radially extending interfitting teeth and teeth-receiving grooves.

8. The apparatus of claim 5 wherein the first frame means includes a pair of guide rods for slidably mounting at least one of the pressure plates.

9. The apparatus of claim 8 further comprising a pair of threaded rods threadingly coupled to one of the pressure plates, and gear train means coupling the crank arm to the threaded rods for substantially simultaneous rotation thereof so as to advance the one pressure plate along the threaded rods as the threaded rods are rotated in response to rotation of the crank arm.

10. Mixing apparatus for pulverulent materials, comprising:

an outer enclosure defining an opening;

a door movable between a closed position blocking the opening and an open position;

a pair of opposed pressure plates;

first frame means for mounting the pressure plates for movement toward and away from each other, between clamped and unclamped positions, into and out of clamping engagement with a container disposed between the pressure plates, respectively;

second frame means for mounting the pressure plates for a mixing motion which mixes the contents of the container;

mixer drive means for driving the first frame means in the mixing motion, the mixer drive means including a power input; and door interlock means including a door stop member supported by the outer enclosure so as to be movable between a first position out of contact with the door and a second position interfering with movement of the door toward the open position, a manually graspable handle movable between first and second handle positions, coupled to the door stop member, switch means coupled to the power input of the mixer drive means for interrupting a flow of power to the power input of the mixer drive means, said handle means engaging the switch means to interrupt power flow to the mixer drive means when the handle means is in the first handle position, with the first handle position corresponding to the first position of the stop member.

11. The apparatus of claim 10 wherein said handle means comprises a handle member and linkage means coupling the handle member to the door stop member.

12. The apparatus of claim 11 wherein the handle member has an arm portion with a free end, means for pivotally mounting the arm portion to the outer enclosure, said linkage means connected to the arm portion so that as the handle member is pivoted, said linkage means is displaced and the free end of the arm portion is brought into contact with the switch means.

13. Mixing apparatus for pulverulent materials, comprising:

an outer enclosure defining an opening;

a door movable between a closed position blocking the opening and an open position;

a pair of opposed pressure plates;

first frame means for mounting the pressure plates for movement toward and away from each other, between clamped and unclamped positions, into and out of clamping engagement with a container disposed between the pressure plates, respectively, the first frame means including a rotating wheel;

second frame means for mounting the pressure plates for a mixing motion which mixes the contents of the container;

mixer drive means for driving the first frame means in the mixing motion, and brake means for engaging the wheel to stop movement of the container disposed between the pressure plates, the brake means including a lever arm which is movable between first and second positions and which interferes with movement of the door toward the open position so as to be moved by the door to the second position as the door is moved to the open position, and wheel-contacting means carried by the lever arm so as to engage the wheel as the lever arm is moved to the second position.

14. The apparatus of claim 13 wherein the wheel-contacting means comprises a roller member coupled to the lever arm.

15. The apparatus of claim 14 wherein the brake means further comprises a plunger which carries the roller member and which is pivotally connected to them lever arm.

16. The apparatus of claim 14 wherein the wheel has an outer surface defining a notch for receiving the roller member.

17. The apparatus of claim 16 wherein the roller member is biased against the outer surface of the wheel as the lever arm is moved to the second position.

18. Mixing apparatus for pulverulent materials, comprising:

a pair of opposed pressure plates;

first frame means for mounting the pressure plates for movement toward and away from each other, between clamped and unclamped positions, into and out of clamping engagement with a container disposed between the pressure plates, respectively;

second frame means for mounting the pressure plates for a mixing motion which mixes the contents of the container;

mixer drive means for driving the first frame means in the mixing motion, the mixer drive means including a power input;

clamping drive means mounted on the first frame means for moving at least one of the pressure plates between the clamped and unclamped positions, the clamping drive means including a crank arm, means for rotatably mounting the crank arm to the first frame means, and at least one manually graspable handle means which is mounted on the crank arm for movement between locked and unlocked positions;

lock means carried by the first frame mean for locking the crank arm against rotation in a first direction and for unlocking the crank arm when the crank arm is moved in a direction opposite to the first direction;

clutch means carried by the first frame means, coupling the crank arm to pressure plates so as to limit the force applied by the crank arm to the pressure plates;

an outer enclosure defining an opening;

a door movable between a closed position blocking the opening and an open position;

door interlock means including a door stop member supported by the outer enclosure so as to be movable between a first position out of contact with the door and a second position interfering with movement of the door toward the open position, a manually graspable handle movable between first and second handle positions and coupled to the door stop member, switch means coupled to the power input of the mixer drive means for interrupting a flow of power to the power input of the mixer drive means, said handle means engaging the switch means to interrupt power flow to the mixer drive means when handle means is in the first handle position, and the first handle position corresponding to the first position of the stop member; and brake means for engaging the wheel to stop movement of the container disposed between the pressure plates, the brake means including a lever arm which is movable between first and second positions and which interferes with movement of the door toward the open position so as to be moved by the door to the second position as the door is moved to the open position, and wheel-contacting means carried by the lever arm so as to engage the wheel as the lever arm is moved to the second position.

* * * * *